United States Patent [19]

Fox

[11] 4,144,685

[45] Mar. 20, 1979

[54] BUILDING CONSTRUCTION

[76] Inventor: Robert C. Fox, APDO 6721, San Jose, Costa Rica

[21] Appl. No.: 749,366

[22] Filed: Dec. 10, 1976

[51] Int. Cl.[2] ..... E04B 1/342; E04C 3/26

[52] U.S. Cl. ..... 52/223 R; 52/82; 52/236.1; 52/744; 52/745

[58] Field of Search ..... 52/745, 747, 82, 227, 52/223 R, 230, 606, 577, 576, 600, 220, 248, 794, 236.2, 236.1, 744

[56] References Cited

U.S. PATENT DOCUMENTS

| | | | |
|---|---|---|---|
| 1,334,881 | 3/1920 | Bennett | 52/223 R |
| 1,683,600 | 9/1928 | Black | 52/220 |
| 1,949,682 | 3/1934 | Pavesi | 52/600 |
| 2,184,714 | 12/1939 | Freeman | 52/220 |
| 2,641,449 | 6/1953 | Antony | 52/220 |
| 3,295,265 | 1/1967 | Hida | 52/220 |
| 3,432,978 | 3/1969 | Erickson | 52/227 |
| 3,640,038 | 2/1972 | Heron | 52/248 |
| 3,724,157 | 4/1973 | Miram | 52/745 |
| 3,869,530 | 3/1975 | Williams | 52/248 |

FOREIGN PATENT DOCUMENTS

| | | | |
|---|---|---|---|
| 711894 | 9/1931 | France | 52/745 |
| 743754 | 4/1933 | France | 52/576 |
| 981570 | 5/1951 | France | 52/745 |
| 1099483 | 9/1955 | France | 52/227 |
| 707352 | 3/1966 | Italy | 52/79.4 |

*Primary Examiner*—John E. Murtagh

*Attorney, Agent, or Firm*—Woodard, Weikart, Emhardt & Naughton

[57] ABSTRACT

A one-story building having a polygonal floor with a centrally located mast, has exterior walls tilted up from horizontal by means of tackle mounted to the mast. The walls are of a cast cementitious material with embedded rectangular grid of bamboo tubes. Continuous strings of barbed wire extend lengthwise inside the horizontal tubes of the grid around the entire perimeter of the building from one jamb to the other of a doorway in one of the exterior walls to bind walls together. Selected ones of the horizontal and vertical tubes used for electrical and plumbing conduits. Tubes are filled with concrete after erection of the walls. The mast and tackle thereon are used to erect a multipanel roof to position where it is supported on the mast and walls.

23 Claims, 9 Drawing Figures

BUILDING CONSTRUCTION

BACKGROUND OF THE INVENTION

1. Field of the Invention

This invention relates generally to building construction, and more particularly to one-story building construction combining low cost and great strength.

2. Description of the Prior Art

Prior art patents noted in the course of a search for my invention are as follows:

| Patent No. | Inventor | Issue Date |
|---|---|---|
| 1,329,292 | Christin | Jan. 27, 1920 |
| 1,420,220 | Roux | June 20, 1922 |
| 1,949,692 | Pavesi | March 6, 1934 |
| 3,134,200 | Moss | May 26, 1964 |
| 3,461,626 | Aitken | Aug. 19, 1969 |
| 3,494,092 | Johnson et al | Feb. 10, 1970 |
| 3,593,482 | Johnson | July 20, 1971 |
| 3,708,944 | Miyake | Jan. 9, 1973 |
| 3,731,440 | Welz | May 8, 1973 |
| 3,874,139 | Landwoski | April 1, 1975 |
| 739,541 | Brusa | Jan. 13, 1933 (French) |
| 430,322 | Helfenstein | Mar. 16, 1934 (British) |

Different ones of these patents disclose features having some relationship to my invention.

For example, the Christin, Roux and Pavesi patents show panel members having reinforcing tubes or reeds of bamboo or the like therein. Moss discloses a method of erecting a polygonal building having accordion-folded and stacked wall panels and using a drawcord and wrench to draw lower ends of roof bows toward each other to close the polygon and create a domed roof. Aitken discloses a central column in a hinged, collapsable structural cover assembly wherein the column is provided with water and electrical conduits and heating and cooling devices. Cables control lowering of the roof sections.

The Johnson patents disclose the concept of pivoting horizontal and vertical panels together. Miyake uses a strand to establish and maintain a structural shape to construct an arch. Welz shows a cable used between folding wall panels to hinge them together and fasten them tightly together at the joints by tensioning the cable.

The Landwoski patent discloses pre-formed or precast concrete panels for foundation or basement wall portions of a building, or for above grade walls and which have hollow tubes molded therein to add rigidity, reduce weight, and provide conduits for electrical, heating and plumbing connections, if desired. Panel edges are such that, after installation on a footing, concrete is to be used for filling the keyway between the footing and the panels and the cavities between edges of panels and the aligned grooves in the tops of the panels.

The French patent discloses artificial boards for building construction and made of reeds arranged parallel and coated with mortar. The British patent discloses wall construction using a rectangular arrangement of reinforcing rush stalks tied together by wires and embedded in a base material of gypsum or the like.

There remains a need for complete, low-cost structures which will provide reliable and durable housing particularly in those portions of the world which frequently experience earthquakes.

SUMMARY OF THE INVENTION

Described briefly, according to a typical embodiment of my invention, a building is constructed by separately fabricating a floor and wall panels in a horizontal condition. The wall panels are tilted up to a vertical position and tied together with continuous strands of material disposed inside the tubes in the panels and extending completely around the perimeter of the building. Grids of upstanding and generally horizontal tubes embedded in the wall panels are subsequently filled by pressure with a subsequently setting material. Some of the tubes are used for utility service conduits. A multi-panel roof structure may be employed using a central mast for central support, which mast may also be useful in arrangement of tackle for tilting up the walls and for erecting the roof.

DESCRIPTION OF THE PREFERRED EMBODIMENT

Figure 1:
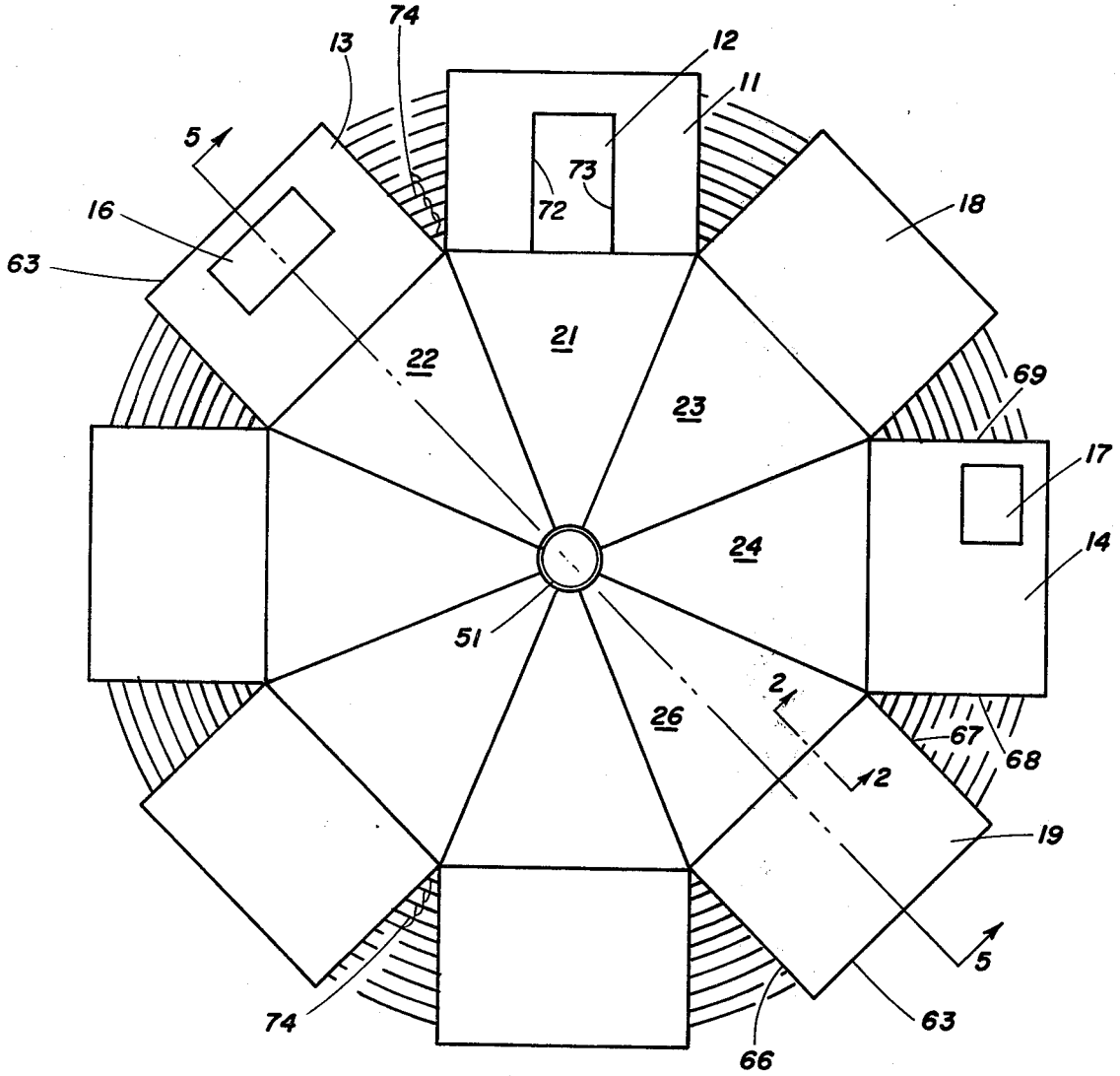
FIG. 1 is a top plan view of the invention showing the floor and eight walls in position prior to tilting the walls to the vertical position.

Referring now to the drawings in detail, the preferred embodiment of the building can be laid out by dividing up a circle. In the illustrated embodiment, it is an octagonal configuration in which the walls are rectangular and, when erected, form an octagonal enclosure. Each of the eight walls can have windows and doors therein, or any combination of windows or doors, or neither. The wall 11 is shown with a doorway 12, while the walls 13 and 14 are shown with windows 16 and 17, respectively, while walls 18 and 19 are shown with no windows at all, as are the remaining three walls. The floor is octagonal and divided into eight generally pie-shaped sectors such as 21, 22, 23, 24 and 26, for example. The walls and floor can be fabricated at the building site in the position shown in FIG. 1, flat on the ground. Alternatively, the floor sectors and walls can be fabricated at a separate site and shipped to the building site by truck.

Figure 2:
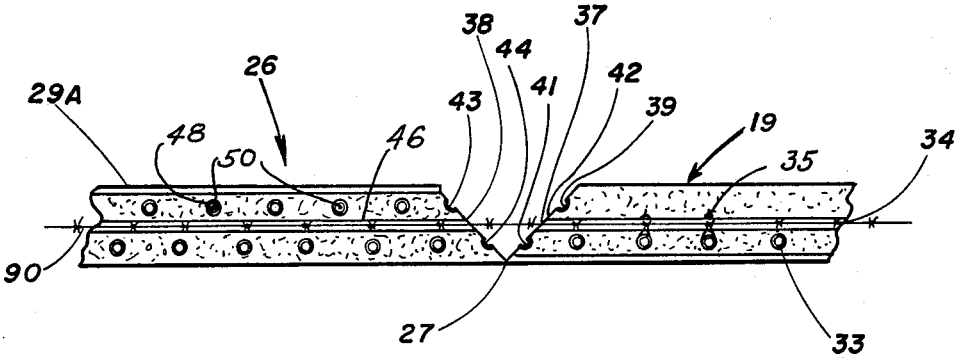
FIG. 2 is a fragmentary sectional view of a junction of the floor and wall in the position shown in FIG. 1, prior to tilting up.
Figure 3:
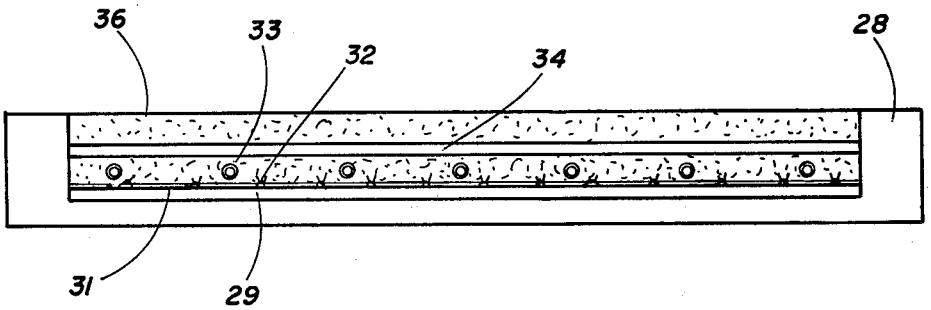
FIG. 3 is a sectional view showing a way of molding or casting a wall panel.

Referring now to FIG. 2, an enlarged detail of the pre-tilt junction 27 between the wall 19 and floor sector 26 is shown. The wall may be constructed as shown in FIG. 3 by providing a form 28 in which concrete can be poured. As an example of construction where thin wood is to be the exterior surface of the wall, the wood 29 is placed in the bottom of the form. A plastic sheet 31 is placed on top of the wood. A barbed wire mat 32 is then stapled to the plastic, with the staples being secured in the wood. Plastic sheet material such as polyethylene of a four-mil or six-mil thickness may be used for sheet 31.

After the barbed wire mat has been secured over the plastic and to the wood 29, a mat of bamboo is placed on top of it. The bamboo is preferably the hollow tubular bamboo, and the bamboo tubes 33 which will be horizontal when the wall is erected, are placed almost immediately adjacent the barbed wire so that they will be near the outer face of the wall when the wall is erected. The tubes 34 which will be the vertical tubes, serving as wall studs when the wall is erected, are placed near the inner face of the wall. Tubes 34 and 33 are preferably two inch and one inch diameter bamboo, respectively. They may be located on three inch to seven inch center spacing, preferably about six inch spacing. Barbed wire may be used to tie the horizontal and vertical tubes together where they cross over each other, providing a rectangular grid of tubes. Then the form is filled with a settable material 36, such as 4000 pounds per square inch (psi) concrete, four to six inches thick, for example.

Referring again to FIG. 2, the wall panel 19 is constructed as just described with reference to FIG. 3. The floor portion or sector 26 may be constructed as described for wall panel 19, except that hardwood or vinyl tile can be used in the bottom of the form in place of the thin wood. A plastic sheet can be used for a moisture barrier. A barbed wire mat can be employed along with the mat of bamboo tubes for reinforcement and durability, followed by pouring with concrete. After the floor panel has set and cured, it can be shipped to the building site and inverted, whereupon the hardwood or vinyl tile surface would be on top as at 29A in FIG. 2, and serve as the finished floor. It should also be understood that the floor can be poured at the building site, and the layers of materials such as vapor-barrier plastic sheet, reinforcing wire, reinforcing or conduit tubes, and any other desired features incorporated directly in the pour at the building site. A finished floor material could be installed later by adhesive or other means.

As shown in FIG. 2 for the joint 27, the wall edge 37 is beveled or chamfered as is the floor edge 38. At this location, a pair of bamboo shells 39 and 41 which have been tubes split longitudinally (ripped), may be mounted at the edge so that they open at the face 42 of the edge of the wall which will be down when the wall is tilted up. Similarly, ripped tubes 43 and 44 may be employed at the outer edge of the floor and open flush with the edge so that, when the wall is tilted up to the vertical position, the two faces will be perfectly matched and the shells 41 and 44 will combine to provide a single tube, and the tube halves 37 and 43 will combine to form a single tube. These are subsequently force-filled with concrete and, when concrete is set, will key the wall and floor together so that they cannot move. The shell pairs serve as keyways for the miter joint of wall to floor.

Figure 4:
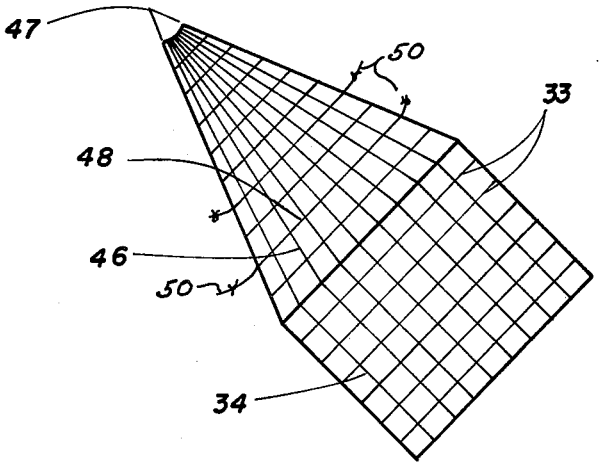
FIG. 4 is an enlarged diagrammatic illustration of a sector of the floor and one of the walls showing one layout of the reinforcing mats therein.

It was mentioned above that the wall and floor have tubes of bamboo embedded in them. FIG. 4 is a diagrammatic view illustrating a possible arrangement of such tubes. Note the ends of tubes 34 which are the vertical tubes when the wall is erected, are in registry with the outer ends of the tubes 46 which radiate from the center 47 of the floor portion. The tubes 48 are generally parallel to the tubes 33 when the unit is flat on the ground. Barbed wires 50 can be used in tubes 48 and extending through aligned tube ends in adjacent sectors, with the tubes 48 subsequently packed with concrete, for tying and reinforcing a base assembly of pie-shaped floor sectors. Any of the tubes may be used as conduits for electrical or plumbing purposes.

Figure 5:
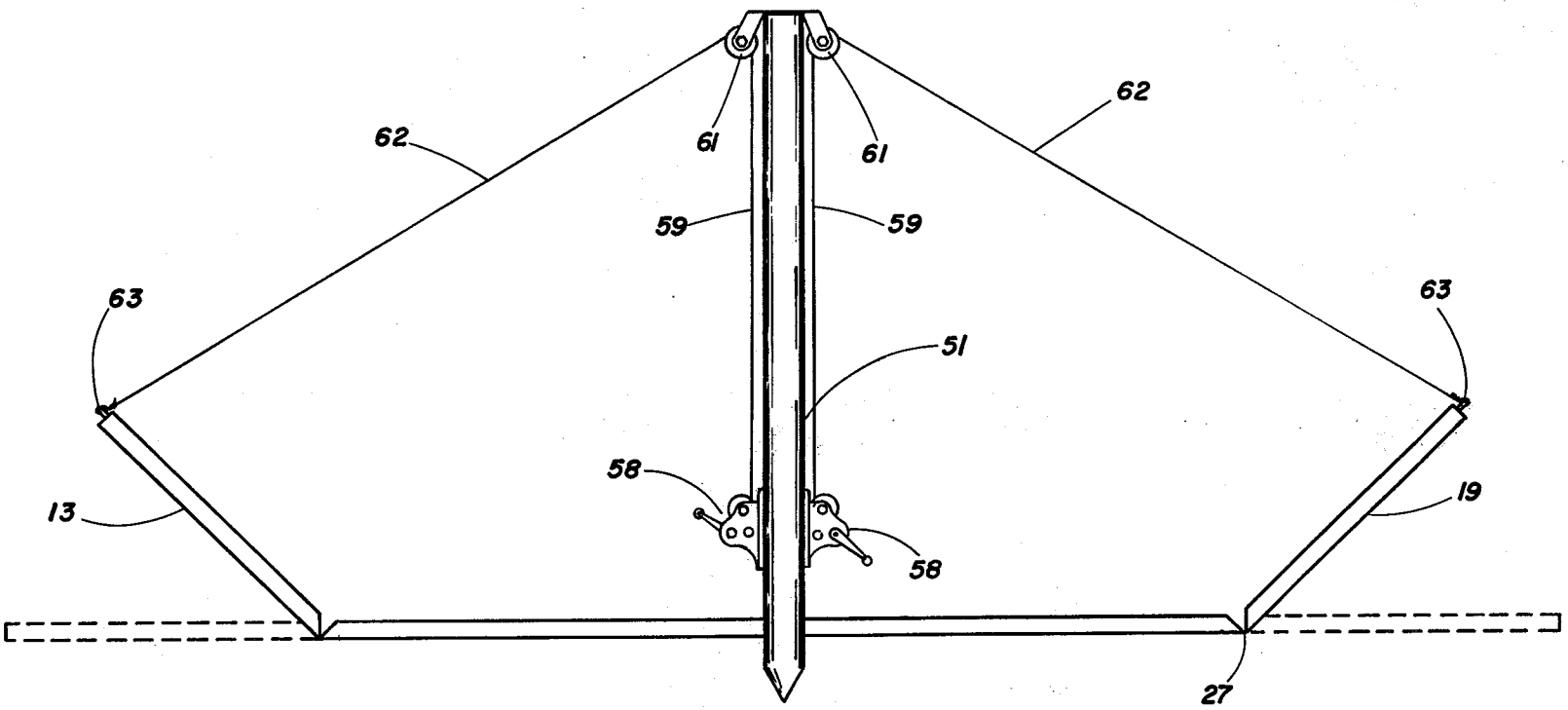
FIG. 5 is a section taken at line 5—5 in FIG. 1 and viewed in the direction of the arrows, but showing two of the walls being tilted up to the vertical condition.
Figure 7:
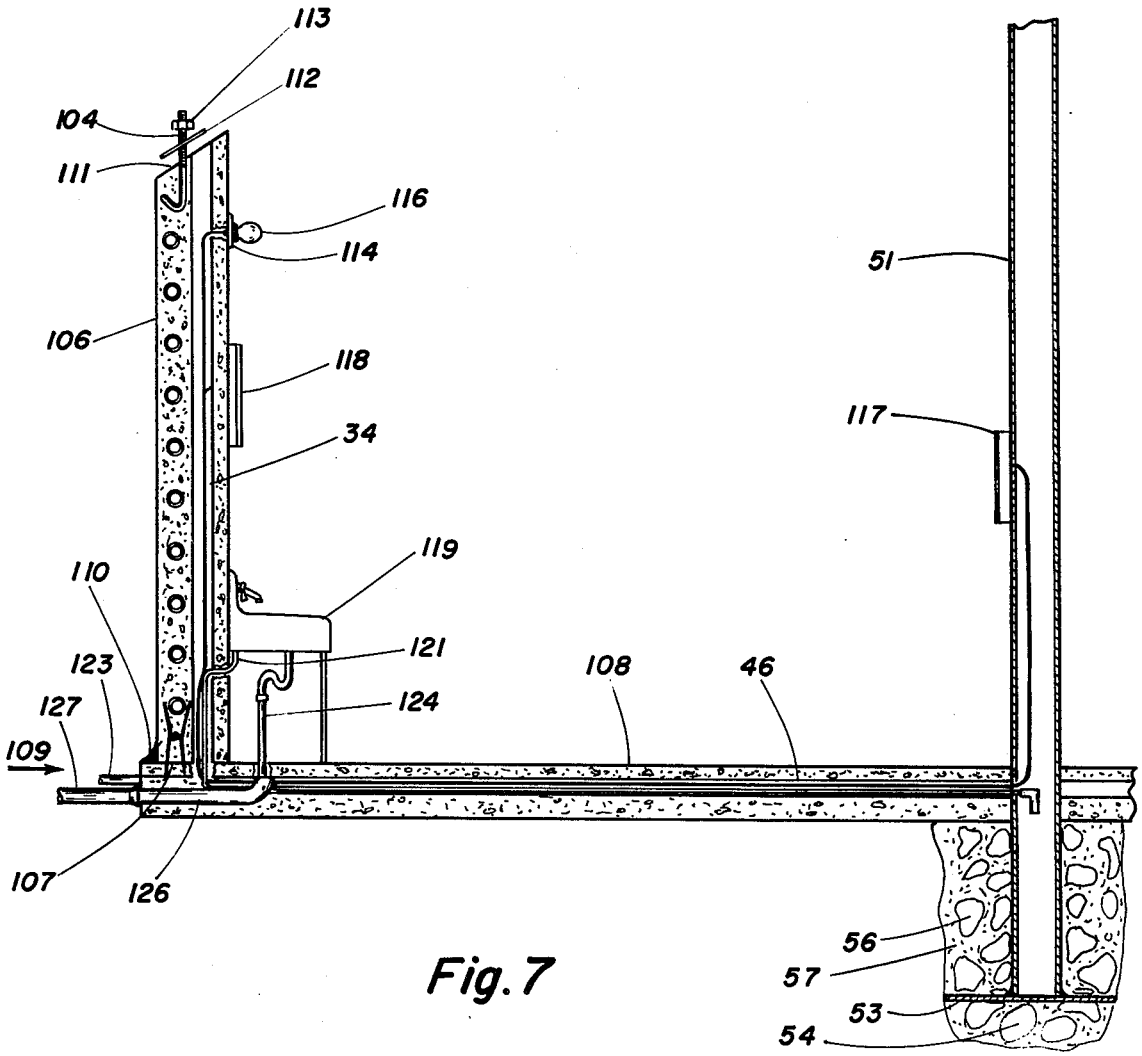
FIG. 7 is an enlarged fragmentary section showing another embodiment of the invention wherein the connection of the wall to the floor is of a different construction from that shown in FIG. 2.

For purposes of example, the length of the walls may be 12 feet, and the corners (junctions of one wall to another) may be 15 feet from the center of the building. The walls may be eight feet high when erected. A mast 51 (FIGS. 1, 5 and 7) which may be a steel tube three feet in diameter, for example, may be employed at the center of the building. As shown in FIG. 7, it may be set in a hole in the ground as at 52. It may have feet 53 welded to the bottom of it and resting on and held down by boulders 54 and 56, respectively. Subsequently concrete may be poured onto the feet and around the mast as at 57, thus securing it firmly in the ground.

Suitable tackle may be temporarily or permanently secured to the mast. Temporary attachment is considered more efficient in terms of cost. An example includes a pair of hand-operated winches 58 mounted diametrically opposite to each other on the mast and secured by bolts. Cables 59 from these winches extend up and around pulleys 61 attached near the top of the mast and extend outwardly therefrom at 62 to points of attachment at the top edges 63 of the walls. These may be the top edges of walls 13 and 19 of FIG. 1, for example. The two winches are operated in unison to raise the walls 13 and 19 from the dotted line positions (FIG. 5) flat on the ground, to vertical positions. The raising of diametrically opposite panels provides even load distribution on the mast. As the panels are raised, the joint 27 closes and the vertically disposed tubes 34 register with the radial tubes 46 in the floor.

After two walls are raised to the vertical position, they can be secured by suitable props until the next two diametrically opposite walls are lifted up. Those two may then be propped while the next two are tilted up. This sequence may be followed until all of the walls are up. If space, available personnel and tackle are sufficient, all walls might be lifted up at the same time. The number of cables for any single wall may depend on the overall weight of the wall, the mechanical advantage on the particular winch or winches used for tilting the wall up, the availability of power-operated winches, and similar factors.

Figure 6:
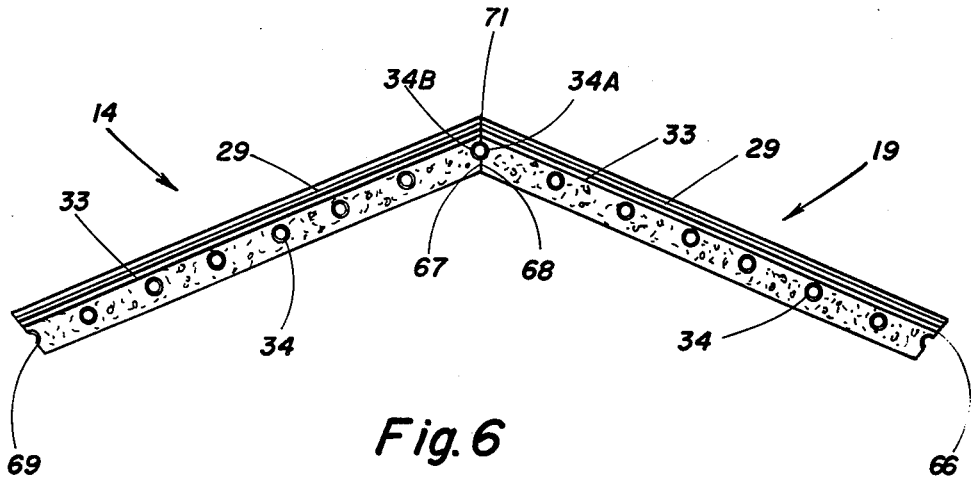
FIG. 6 is an enlarged fragmentary plan view showing two of the walls and emphasizing the construction at the corner joint of the erected walls.

When the walls are up, the junction of the walls with each other is as shown in FIG. 6. As described with reference to FIG. 2, where the lower edge of the wall is beveled or chamfered, so beveled are the vertical side edges of the walls such as at 66 and 67 for wall 19, and 68 and 69 for wall 14, to provide a miter joint. Likewise, the bamboo members 34A and 34B at the side edges of the walls are shells made of ripped tubes so that when the walls 14 and 19 meet at the junction 71, the shells 34A and 34B combine to form a single vertical tube like the embedded tubes 34. Also the horizontal tubes 33 are beveled at their ends so that the ends form a neat and complete junction in complete leakproof alignment or registry with each other for a purpose which will be described forthwith. All of the wall joints are constructed in the same way.

Figure 8:
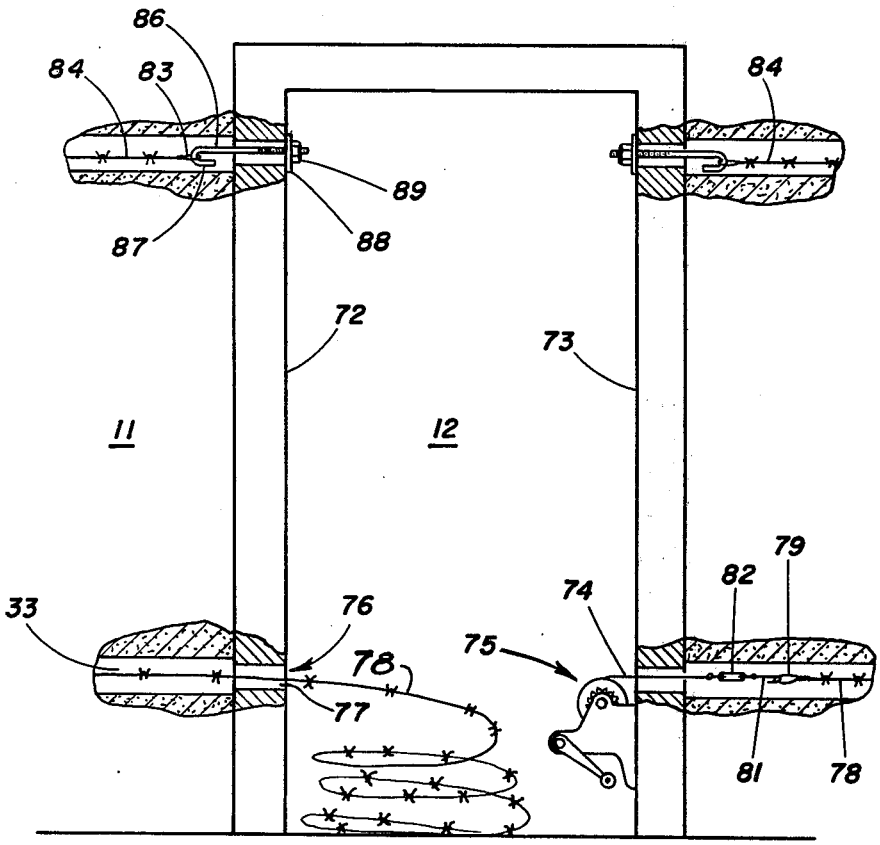
FIG. 8 is an enlarged fragmentary diagrammatic view of the securing of the ends of the binding wires at a door jamb.

It was mentioned above that wire is employed to bind the walls together after erection. The horizontal bamboo tubes in the walls having their ends in registry with each other at the joints, facilitate this feature. It is accomplished by having barbed wire extending from a left-hand door jamb 72 of the doorway 12 of FIG. 8 through the bamboo tubes having their ends in registry with each other in all of the eight walls entirely around the building, and back to the door jamb 73 in FIG. 8. One way of accomplishing this purpose is to provide smooth wires as at 74 in FIG. 1 and thread one such wire through one of the bamboo tubes 33 where it registers with door jamb 72, and feed it in the direction of arrow 76 through the hole 77 in the door jamb and into the tube 33 in wall 11. When the wire begins to protrude from the edge of wall 11, it is then fed into the corresponding bamboo tube 33 of wall 13, and from wall 13 into the next wall and so on around the unit until the end becomes exposed at the door jamb 73. A winch such as 75 temporarily mounted to the door jamb 73, may have the end of the wire 74 connected to it whereby the winch can be used to pull the wire. The same can be done for all of the other horizontal tubes. In walls where a window opening interrupts the wall and the tubes therein, the wires can nevertheless be used and extended from the window frame in that wall to the next window frame or door jamb in succession around the building and be winched and secured in the same manner as for the door jamb in FIG. 8 which will now be described.

As the various walls are lifted up, even if the lifting is done to pairs of walls sequentially, the winches at the door jambs can be wound to maintain a neat and knot-free condition of the wires in the tubes 33. Then, after the walls have been erected and all of them are in the vertical position with the joints closed as in FIG. 6, a barbed wire 78 can be connected by a suitable eye 79 welded to the end thereof and a hook 81 connected to the end of wire 74 by a suitable connector or weld 82. This connection would be made at the trailing end of wire 74, the lead end having already been wound onto the winch 75 at the door jamb 73. Thus the connection of the barbed wire would be made at the trailing end exposed at door jamb 72. The winch can then be used to pull ("fish") the barbed wire into the aperture 77 in door jamb 72 and through the tubes in registry until the loop has reached the position shown in FIG. 8. Then a loop can be fastened to the opposite end of the barbed wire as at 83 for wire 84 in another one of the tubes, and a bolt 86 may be secured through the loop by means of the hook 87 at the end of the bolt. Application of a suitable washer 88 and nut 89 thereon will prevent the wire from being pulled any further. Then the hook 81 on the "fish" wire 74 can be disconnected from the eyelet or loop 79 of the barbed wire, and another bolt connected thereto just as described above for the barbed wire 84. This would occur after removal of the winch. Then the two bolts connected to the opposite ends of the barbed wire and bearing on the door jambs 72 and 73, respectively, can be tightened to the extent desired to securely bind all of the walls together. The same technique can be used for all of the horizontal tubes which are in registry with each other at the joints. Accordingly there is provided a very secure structure.

As described above, selected ones of the horizontal and vertical tubes can be used for electrical conduits or for fluid conduits for handling liquids or gases. The tubes themselves may be used for this purpose or can be used to house tubes or pipes which may be considered more appropriate for handling such materials. For those which are not used for conduit purposes, an additional feature of the invention is to pressure-fill them will a settable material. An example is concrete. For that purpose, the vertical tubes 34 are pressure-filled by applying pump hose nozzles to the upper ends of the tubes as at 91 in FIG. 9, for example, to pack them with concrete. The lower ends are either blocked off at the floor or communicate with aligned ends of radially extending tubes such as 46 in FIG. 4 which are thereby likewise pumped full of concrete. These tubes are blocked off at the mast. Prior to filling with concrete, barbed wire 90 (FIG. 2) can be in the tubes 34 and 46 throughout their lengths for additional strength when it is then embedded in the concrete grout packing the tubes. A possible alternative to filling tubes from their ends, is to provide pressure-fill fittings at various locations on the walls or in the floor and communicating with these tubes. Similarly, the horizontal tubes may be pressure-filled by applying or force-feeding concrete thereto at the door jambs or window jambs, as the case may be. The concrete can be forced in until it begins to come out the tube in the opposite door jamb. In the case of the filling of the vertical tubes, the lower ends thereof or the inner ends of the radial tubes 46 may be opened initially to permit departure of air therefrom as they are filled with the concrete.

Figure 9:
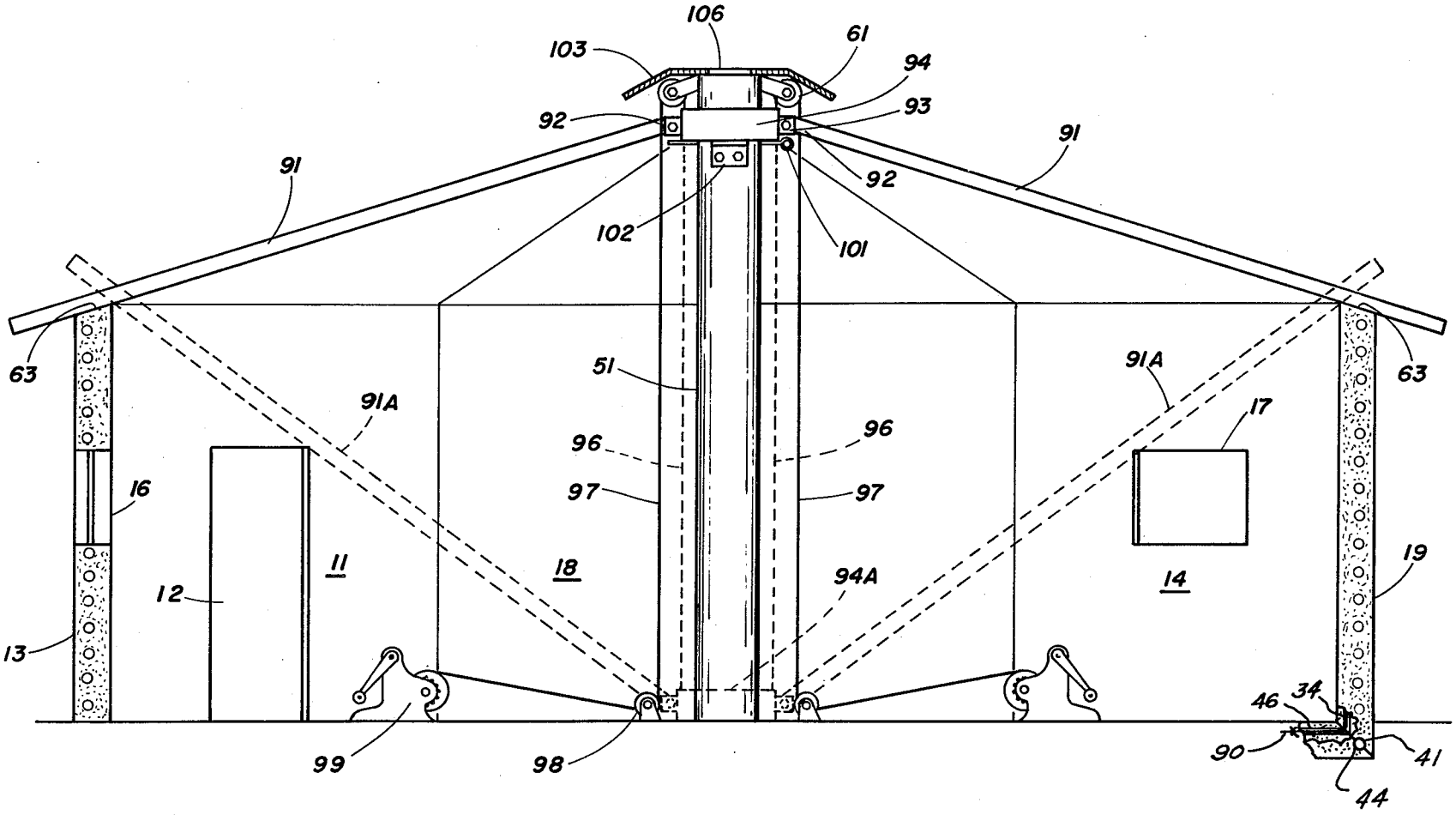
FIG. 9 is a section through the completely erected building shell of a typical embodiment showing the wall-to-floor joints as in FIG. 7 (wall 13) and FIG. 2 (wall 19), and showing the roof panels in position, this section being taken at the same location as line 5—5 in FIG. 1, but with the walls erected.

It may be recognized that the mast can be very useful as a central support for a roof of the building. Roofs of a variety of styles and materials may be employed. One possible way of constructing a roof wherein the mast is used not only for the final support, but also in raising the roof, is shown in FIG. 9. In that figure, where a section is taken along the same line as line 5—5 in FIG. 1, eight pie-shaped sheet metal roof panels such as 91, are shown in the dotted lines 91A with their outer portions resting upon the upper edges 63 of the walls. The inner ends 92A are pinned to the lugs 93 on a collar 94 which encircles the mast. Cables 96 having ends connected to the collar extend up and around the pulleys 61 which may be the same pulleys as previously described for use in tilting up the walls, and then extend downwardly therefrom at 97 and around pulleys 98 connected to the lower end of the mast under the collar, and extend therefrom to winches 99. The winches can be operated in unison to raise the collar and simultaneously raise the inner ends of all of the pie-shaped roof panels. When the collar reaches the upper end of its travel to place the panels at the desired slope to drain water from the roof, the collar can be pinned by insertion of a pin 101 through a hole in the mast to hold the collar at that location. Then it can be secured permanently by means of brackets 102 fastened to the mast and having flanges projecting outwardly and under the collar. The brackets can be secured to the collar by screws or bolts, or can be permitted to simply support the collar resting thereon. Then the pulleys 61 and cables and winches can be removed, and an overcap 103 can be secured to the top of the mast to cover the joints of the panels to the collar. Appropriate seals may be employed both at the mast and at the joints of the roof panels with each other and at their junction with the upper edges of the walls. Of course they would also be fastened to the upper edges of the walls by means such as the hook bolts 104, for example, shown in FIG. 7. As shown in FIG. 9, the overcap 103 is provided with a central aperture 106 communicating with the interior only of the mast. This accommodates use of the mast for a chimney for connection to a fireplace, furnace, stove, water heater or other fuel-burning apparatus. The mast can also serve as a vent for sewers or drain lines. It can also be used for a central supply point for electric, water or gas utilities; and when so used, lines therefrom can be directed radially outward through the tubes 46 in the floor portions, or can be directed radially outward therefrom at above floor heights, and various utility using appliances or devices can be arrayed around the mast for convenience, with appropriate partitions when and where needed.

Referring further to FIG. 7, the wall is identified by reference numeral 106 and has a flat lower edge 107 received flat on top of the floor 108. The wall may be tilted up to this position from a position on the ground, but in which the edge 107 can tilt directly onto the flat top 108 of the floor, or can be tilted up and scooted horizontally in the direction of arrow 109 onto the floor. It can be anchored there by suitable anchor means such as a floor tie in the floor and wall tie in the wall. An appropriate seal 110 can be applied around the perimeter of the building at the joints between the walls and the floor to prevent migration of water through the joint.

The upper edge 111 of the wall may be sloped as shown in FIG. 7 for directly matching the roof pitch, and the upper tie bolt whose lower hooked end is embedded in the wall, projects upwardly for reception of a roof panel thereon. The washer 112 received on the bolt 104 and the nut 113 threadedly received thereon, are useful to secure the roof panel to the wall.

FIG. 7 also illustrates one manner of utilization of the tubing in the wall and floor as conduits. For example, tube 34 receives an electrical cable extending from the wall socket 114 receiving the bulb 116 down into a tube 46 and through that tube into a mast-mounted electrical box 117. An electrical box 118 may be mounted on the outside wall and connected to cables in such tubes. The service box may be located wherever most convenient.

A sink 119 is provided with water supply through pipes 121 which may be mounted in vertical tubes and extend in the horizontal tubes 46 to a supply 123 at the exterior of the building. Similarly a drainpipe 124 can extend down into a drainpipe 126 in the floor slab connected to a drain 127 outside the building. Bamboo tubes of various diameters may be selected for certain ones of the vertical or horizontal tubes in the walls, and for certain ones of the tubes in the floors, in order to accommodate whatever service may be most conveniently established through the tubes. For example, large tubes 46 and 34 may be used for drainpipes, while smaller tubes may be used for water supply pipes, while still smaller tubes may be used for reception of electrical wires.

As suggested above, many or all of the tubes not otherwise occupied, may be force-filled with cement. At the joints, the tube shells such as 34A and 34B in the wall joints will cooperate with the solidified concrete to key the joints. The same is true in the wall-to-floor joints where they are constructed as shown in FIG. 2. In addition, if it will be unnecessary to obtain access to the electrical wiring or other utility service employing these tubes as conduits, they too can be filled with concrete which becomes packed around the exterior of the wiring cable, water supply pipe, or drainpipe received in the tube.

If it is desired to avoid utilizing tubes in the floor for any of the aforementioned services, they can be provided in an overhead way by mounting them in or adjacent the upper edges of the walls and running the feeder wires or pipes down from overhead busses.

From the foregoing it will be seen that a great variety of alternatives in detail is possible within the overall basic building structure and techniques provided according to this invention. The objective can be accomplished with a minimum of cost, both in terms of fixtures, equipment and materials, and with a mimimum of skilled labor. Yet the resulting structure can be extremely durable and provide good, sound, clean and permanent living quarters. The lack of a need for internal supporting walls provides great latitude in choice of partitioning to obtain the divisions of interior space appropriate to the needs of the occupant.

While there have been described above the principles of this invention in connection with specific apparatus, it is to be clearly understood that this description is made only by way of example and not as a limitation in the scope of the invention.

What is claimed is:

1.

A method of building construction comprising the steps of:

arranging a plurality of wall-forming panels in vertical position to form a polygonal enclosure for a base;

binding said panels with elongated flexible tying members;

assembling a plurality of prefabricated base-forming sectors into a polygonal base;

aligning radially extending tubes of said sectors with tubes in said panels;

fitting the aligned tubes together at the junction of the wall-forming panels with base-forming sectors; and filling the aligned tubes with a settable material.

2. The method of claim 1 and further comprising the step of:

causing said material to set up into a rigid cementitious mass in said aligned and filled tubes.

3. A building structure comprising:

a plurality of upstanding wall panels arranged to form a polygon, each panel including a plurality of horizontally extending reinforcing tubes;

certain ones of said horizontally extending tubes of certain ones of said panels having ends aligned with and communicating with ends of horizontally extending tubes of next adjacent panels;

binding means extending through tubes and aligned tube ends of adjacent panels and tying said panels together;

a solidified material filling the ones of said tubes having said binding means in them, said material impeding movement of said binding means in said tubes; and said binding means being barbed wires, one continuous length of such barbed wire extending through a plurality of adjacent panels and binding them together as a unit.

4. The structure of claim 3 wherein:

said material is cement.

5. The structure of claim 4 wherein:

at least some of said tubes have utility service lines in them.

6. A building structure comprising:

a plurality of wall panels arranged to form a polygon, each panel including a plurality of vertically spaced, horizontally extending reinforcing tubes, said tubes in most of said panels extending throughout the whole length of the panel from one edge of the panel to the opposite edge of the panel; certain one of said horizontally extending tubes of certain ones of said panels having ends aligned with ends of horizontally extending tubes of next adjacent panels; at least one of said panels having a vertically extending opening therethrough for a window or the like;

binding means extending through tubes and aligned tube ends of adjacent panels and tying said panels together, said binding means including at least one wire extending through a succession of tubes in successive panels beginning at its anchor point at one side of said opening through said one panel and extending around the perimeter of the polygon through the tubes in successive panels of said polygon and terminating at its anchor point at the opposite side of said opening through said one panel and tensioned to tie said panels together, and at least one additional wire having one end anchored at the one side of said opening through said one panel and said additional wire extending through additional tubes in the successive panels around the perimeter of the polygon and having its opposite end terminating and anchored at the opposite side of said opening through said one panel to tie said panels together; said panels including prefabricated solidified material, with said tubes embedded therein; said horizontally extending tubes being horizontal, said panels including a plurality of vertical tubes embedded in said solidified material;

barbed wire extending in said vertical tubes; and cement filling and set in said vertical tubes.

7. A building structure comprising:

a plurality of upstanding wall panels arranged to form a polygon, each panel including a plurality of horizontally extending reinforcing tubes;

certain ones of said horizontally extending tubes of certain ones of said panels having ends aligned with and communicating with ends of horizontally extending tubes of next adjacent panels;

binding means extending through tubes and aligned tube ends of adjacent panels and tying said panels together;

a solidified material filling the ones of said tubes having said binding means in them, said material impeding movement of said binding means in said tubes;

edges of adjacent panels are being beveled to provide miter joints between adjacent panels;

said aligned tube ends being beveled and fitted together at said miter joints to provide substantially leakproof passageways when pumped full of said material before solidification of said material.

8. A building structure comprising:

a plurality of upstanding wall panels arranged to form a polygon, each panel including a plurality of horizontally extending reinforcing tubes;

certain ones of said horizontally extending tubes of certain ones of said panels having ends aligned with and communicating with ends of horizontally extending tubes of next adjacent panels;

binding means extending through tubes and aligned tube ends of adjacent panels and tying said panels together;

a solidified material filling the ones of said tubes having said binding means in them, said material impeding movement of said binding means in said tubes;

edges of adjacent panels being beveled to provide miter joints between adjacent panels;

each of said edges of adjacent panels at a miter joint being a miter edge and including a vertically extending, elongated groove opening at said edge, the grooves of facing miter edges cooperating to provide panel-to-panel keyways at the miter joints, said keyways being filled with solid keying material.

9. The building structure of claim 8 wherein:

said panels are made primarily of prefabricated, reinforced concrete, and said keying material is concrete.

10. The building structure of claim 8 wherein:

said panels are mounted on a base having a central mast therein; and a roof is mounted on said panels and said mast.

11. The building structure of claim 10 wherein:

bottom edges of said panels and portions of said base are mitered and assembled to provide wall-to-base miter joints of said wall panels to said base;

said mitered bottom edges of said panels and said mitered portions of said base having elongated horizontally extending grooves opening at said bottom edges and at said mitered base portions, said grooves of facing mitered bottom edges and base portions cooperating to provide wall-to-base keyways at the said wall-to-base miter joints, said wall-to-base keyways being fitted with solid keying material.

12. The building structure of claim 11 wherein:

said base includes an array of base tubes therein extending out from a central area to said mitered base portions; and said wall panels include stud tubes extending vertically, certain ones of said base tube outer ends being mitered and aligned with mitered lower ends of certain ones of said stud tubes to provide substantially leakproof miter joints at said wall-to-base miter joints whereby said certain ones of said tubes and base tubes contain solidified binding material.

13. The building structure of claim 12 wherein:

said certain ones of said base tubes and said stud tubes have barbed wire extending therein and embedded in said binding material which is concrete.

14. The building structure of claim 12 wherein:

utility service lines are provided in said tubes.

15. A building structure comprising:

a plurality of prefabricated pie-shaped floor sectors assembled together, edge-to-edge to form a floor, said sectors having grids of variously oriented horizontal tubes therein;

a plurality of prefabricated upstanding wall panels arranged on said floor sectors to form a polygon, at least some of said wall panels having grids of horizontal and vertical tubes therein;

certain tubes of each floor sector having ends thereof aligned with tube ends in adjoining sectors;

certain tubes of said wall panels having ends thereof aligned with ends of certain other tubes of said floor sectors;

and means in said certain tubes tying said floor sectors together.

16. The structure of claim 15 wherein:

said aligned tubes are packed with a solidified material.

17. The structure of claim 16 wherein:

said material is concrete.

18. The structure of claim 15 wherein:

said tubes having ends aligned with tube ends in adjoining sectors have barbed wire extending through them and through tubes in said adjoining sectors, said barbed wire being packed in solidified material.

19. The structure of claim 18 wherein:

said certain tubes of said wall panels have barbed wire extending through them and through the said other tubes of said floor sectors aligned with them.

20. A building structure comprising:

a plurality of prefabricated pie-shaped floor sectors assembled together, said sectors having grids of tubes therein;

a plurality of prefabricated upstanding wall panels arranged on said floor sectors to form a polygon, said wall panels having grids of tubes therein;

certain tubes of each floor sector having ends thereof aligned with tube ends in adjoining sectors;

and certain tubes of said wall panels having ends thereof aligned with certain other tubes of said floor sectors;

communicating elongated horizontally-extending reinforcing tubes in a plurality of said wall panels;

elongated binding means extending through said tubes of adjacent wall panels and tying said adjacent wall panels together.

21. The structure of claim 20 wherein:

said binding means are embedded in a packing material solidified in said tubes through which said binding means extend.

22. The structure of claim 21 wherein:

said binding means include a length of barbed wire extending continuously through communicating tubes of a plurality of adjacent wall panels, binding said adjacent wall panels together; and said packing material is concrete.

23. The structure of claim 21 wherein:

the polygon is an octagon, and there are eight of said floor sectors.

* * * * *